US008814714B1

(12) United States Patent
Hjertstedt

(10) Patent No.: US 8,814,714 B1
(45) Date of Patent: Aug. 26, 2014

(54) SWING TRAINING DEVICE

(71) Applicant: Gabriel Hjertstedt, Scottsdale, AZ (US)

(72) Inventor: Gabriel Hjertstedt, Scottsdale, AZ (US)

( * ) Notice: Subject to any disclaimer, the term of this patent is extended or adjusted under 35 U.S.C. 154(b) by 0 days.

(21) Appl. No.: 14/220,458

(22) Filed: Mar. 20, 2014

(51) Int. Cl.
*A63B 69/36* (2006.01)

(52) U.S. Cl.
CPC ..... *A63B 69/3635* (2013.01)
USPC ..... 473/224; 473/223; 473/233; 473/234

(58) Field of Classification Search
USPC ..... 473/226, 223, 224, 233, 234, 256, 257, 473/297, 316, 519
See application file for complete search history.

(56) References Cited

U.S. PATENT DOCUMENTS

| | | | | |
|---|---|---|---|---|
| 1,676,270 | A * | 7/1928 | Mattison | 473/234 |
| 3,137,504 | A * | 6/1964 | Zordan et al. | 473/457 |
| 3,498,616 | A * | 3/1970 | Hurst | 473/234 |
| 4,027,886 | A * | 6/1977 | Katsube | 473/234 |
| 4,969,921 | A | 11/1990 | Silvera | |
| 5,634,856 | A * | 6/1997 | Rainey | 473/234 |
| 5,711,718 | A * | 1/1998 | Mueller | 473/234 |
| 6,461,163 | B1 * | 10/2002 | Gallagher et al. | 434/252 |
| 7,704,160 | B2 | 4/2010 | Lindner | |
| 2004/0009824 | A1 | 1/2004 | Shaw | |
| 2005/0009618 | A1 * | 1/2005 | Leadbetter et al. | 473/257 |
| 2005/0192112 | A1 * | 9/2005 | Kim | 473/224 |
| 2010/0184526 | A1 | 7/2010 | Park | |
| 2012/0094780 | A1 | 4/2012 | Slaughter et al. | |
| 2012/0244957 | A1 * | 9/2012 | McClung et al. | 473/316 |

* cited by examiner

*Primary Examiner* — Raleigh W Chiu
(74) *Attorney, Agent, or Firm* — Whitley Legal Group, P.C.; AnnMarie W. Whitley

(57) ABSTRACT

A swing training aid comprises at least a shaft that defines an interior channel in which a reciprocating member translates from end to end. Preferably the swing training aid is a golf club comprising a grip and a club head disposed at opposite ends of the shaft. The grip can also define an opening at one end that cooperates with a fixed or removable end cap that optionally comprises one or more additional features such as a magnet for attracting the reciprocating member and an insert that produces an audible sound when struck by the reciprocating member. The club head may also include additional features such as an insert that produces an audible sound when struck by the reciprocating member. To use the swing training aid, a golfer swings the training aid and the reciprocating member provides tactile and audible feedback when the backswing, downswing, and finish are correct.

6 Claims, 5 Drawing Sheets

SWING TRAINING DEVICE

FIELD OF THE INVENTION

The present invention relates to sports training aids and, more particularly, to a swing training aid for improving a user's golf swing.

BACKGROUND OF THE INVENTION

In the game of golf, a golf club is used to strike a golf ball. The golf club consists of a long shaft, a grip on one end, and a weighted head on the other end. The head of golf club is inclined to give the golf ball an upward trajectory. Early golf clubs were made entirely of wood and golf balls were made of stuffed leather. Over time, golf balls were made of more durable materials, and golf clubs, especially those designed for shorter, high-trajectory shots, were improved with iron heads. By the 1920s, golf clubs were improved again with the introduction of steel shafts, and, in the 1970s, golf clubs with fiber-reinforced composite shafts were introduced. Currently, golf clubs are made with a wide variety of raw materials including metals, plastics, ceramics, composites, and wood. Golf club designers continually strive to improve the materials, dimensions, and features of golf clubs while adhering to the rules of governing bodies such as the United States Golf Association (USGA) and the Royal & Ancient (R&A).

As golf clubs have steadily improved over time, golfers have also been trying to improve their golf swing mechanics. Swing mechanics involve one's grip, stance and posture, alignment, takeaway, hip and shoulder turn during backswing and downswing, body position at impact, follow through, timing and tempo, body position at finish, and overall balance. By improving one's swing mechanics, a golfer hopes to achieve better shots and lower his or her score. In particular, a golfer can hit the ball farther and with better accuracy. While improving one's swing mechanics generally requires hours upon hours of practice, it can be accelerated with the use of one or more swing training aids.

Currently popular swing training aids include weighted shafts, hinged shafts, and shafts with magnetic timing balls. Training aids with weighted shafts generally consist of a shaft with a grip at one end and a weight at the opposite end. Swinging the weighted shaft builds strength and speed. Training aids with hinged shafts generally consist of a shaft with a grip at one end, a head at the opposite end, and a hinge located along the shaft that causes the shaft to bend or break when the club travels outside the proper swing plane. Swinging the hinged shaft improves tempo and swing alignment. Training aids with a magnetic timing ball generally consist of a shaft with a grip at one end and a stopper at the opposite end and a magnetic timing ball that cooperates with a magnet positioned at the bottom of the grip and in some cases also at the stopper. In order to optimally release the magnetic timing ball from its position at the end of the grip, a golfer has to release the club head at the bottom of his swing arc, which improves the golfer's timing. Additional types of swing training aids include molded grips designed to force a golfer to maintain a particular grip during his swing, wrist sleeves designed to keep a golfer's wrist in the optimum position, adjustable hoops or stand and strap combinations designed to guide the golf club through the optimum golf swing plane, and straps for adjusting and maintaining the user's stance or correcting other body positioning mistakes.

Unfortunately, the currently available swing training aids are inconvenient, sometimes cumbersome, and often aim to improve only one or two components of a golfer's swing.

Some aim to increase strength and timing yet do not allow the golfer to strike the ball with the training aid. Others simply guide the club along a proper swing plane. It would be desirable to provide an apparatus that allows a golfer to improve his swing mechanics, that is convenient to use and carry, that teaches timing and proper swing technique, and that allows the golfer to strike a golf ball. It would be further desirable to provide an apparatus that provides tangible positive feedback when a golfer executes a proper golf swing.

SUMMARY OF THE INVENTION

The swing training aid comprises a club having at least a shaft and a reciprocating member. Additionally and preferably, the swing training aid further comprises a grip and a club head. The shaft comprises a first end and a second end, and the grip is attached to the shaft at its first end. The head is attached to the second end of the shaft, and the shaft comprises an inner wall that defines a channel extending along the longitudinal axis of the shaft. The reciprocating member is positioned within the channel defined by the shaft and reciprocates within the channel between a first position and a second position. The grip can also define an opening at one end that cooperates with a fixed or removable end cap. The end cap or grip can further comprise one or more additional features such as a magnet for attracting the reciprocating member and an insert that produces an audible sound when struck by the reciprocating member. The club head or the second end of the shaft may also include one or more additional features including an insert that produces an audible sound when struck by the reciprocating member. Further additional features include a stopper for shortening the channel length and a locking mechanism for securing the reciprocating member when not in use.

To use the swing training aid, a golfer grips the training aid, assumes an appropriate stance, and aligns the face of the club head with a golf ball. Next, the golfer begins a takeaway movement where the hands and arms move together away from the body as the swing training aid is swung back and away from the golf ball. During the backswing, the reciprocating member translates within the channel of the shaft. If the golfer keeps the training aid in the proper swing plane and when the golfer reaches the ideal top of his backswing, the reciprocating member reaches the first end of the shaft and, if an insert is present, produces an audible sound. Most golfers will be able to feel the reciprocating member strike the first end of the shaft and preferably will also hear an audible sound. After hearing and feeling the cue given by reciprocating member at the top of the backswing, the golfer releases the training aid and begins his downswing. The golfer strikes the ball with the club head and then follows through with his swing to a finish position. As swing training aid travels through the downswing and through impact with the ball, reciprocating member translates from one end of the shaft to the other. As with the backswing, most golfers will feel positive feedback when swinging properly as the reciprocating member smoothly translates within the shaft. As the golfer feels and possibly hears the positive feedback from the swing training aid when he strikes the ball, the golfer will also optimally strike the ball and see the positive outcome of his improved swing.

DETAILED DESCRIPTION OF PREFERRED EMBODIMENTS

Figure 1:
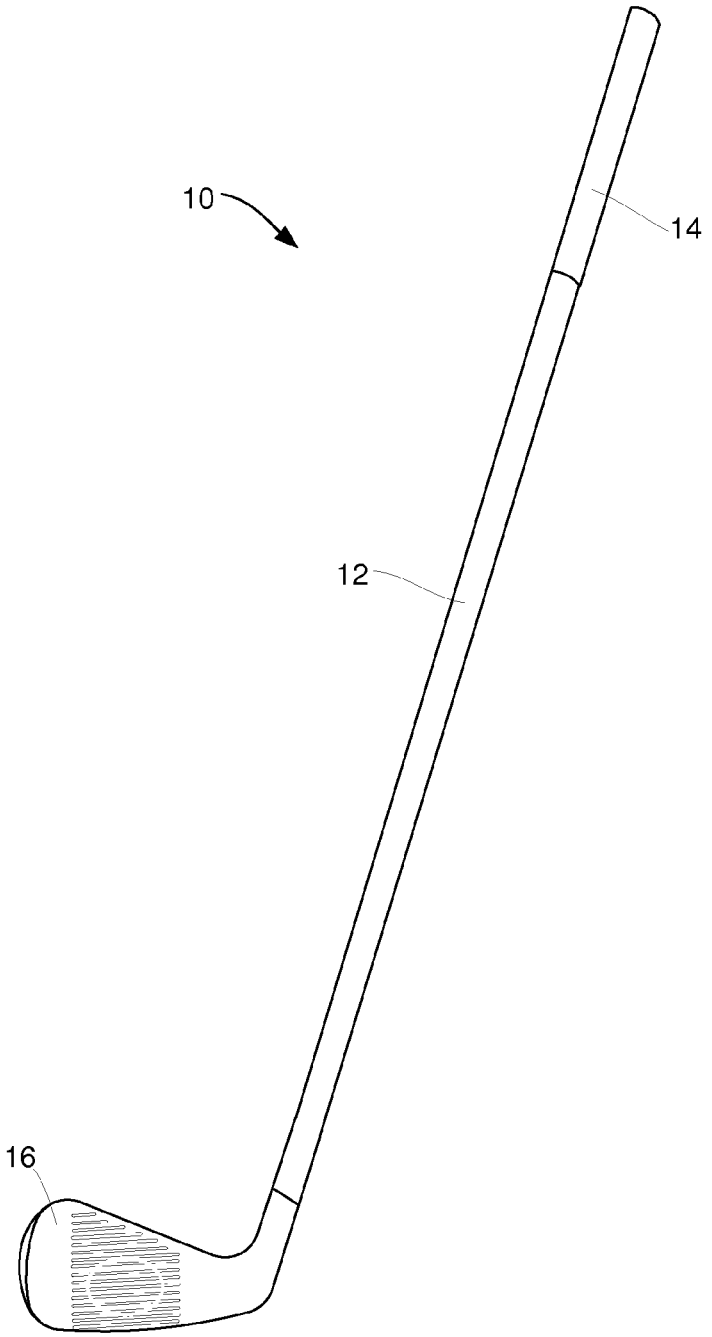
FIG. 1 is a perspective view of the swing training aid of the present invention.
Figure 2:
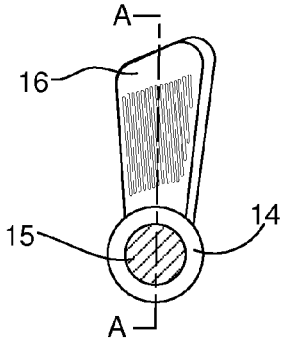
FIG. 2 is a top view of the swing training aid of the present invention.
Figure 3:
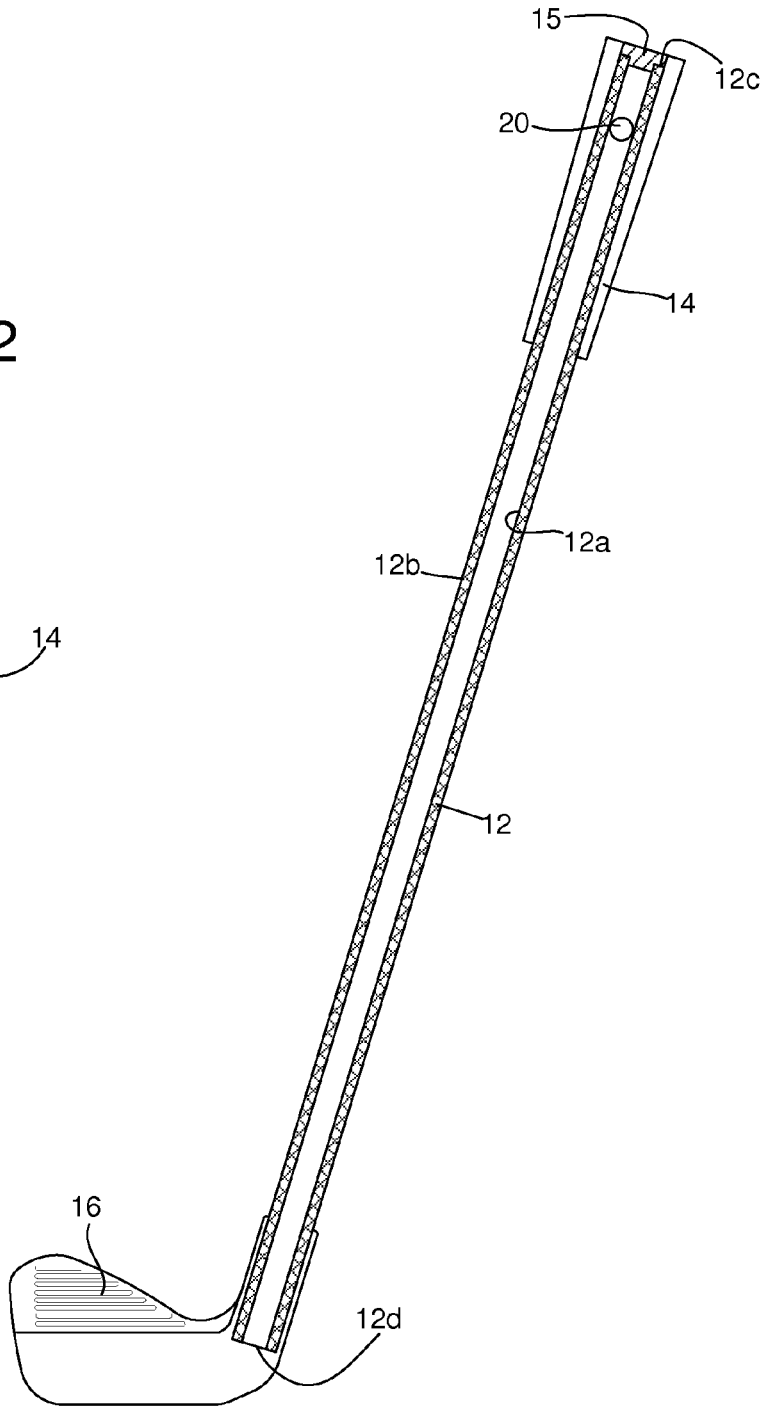
FIG. 3 is a cutaway side view of an embodiment of the swing training aid of the present invention as cut according to the line A-A in FIG. 2.

FIGS. 1-3 illustrate the preferred embodiment of a swing training aid 10 of the present invention. Swing training aid 10 can be used to improve the swing mechanics of any recreational or professional athlete who swings a club, bat, or similar equipment. Swing training aid 10 is particularly useful for the recreational or professional golfer as it provides audible and tactile responses when swinging the golf club. In particular, it can teach a golfer to avoid overswinging on a backswing, to create a smooth and powerful change of direction at the top of the swing, to use a three-quarter backswing as used by many professional golfers, and to realize the benefit of a short and powerful swing. Additionally, by using the swing training aid 10 of the present invention, a golfer may increase his swing speed, learn to use his body more and shorten his arm position as seen among top professional golfers, improve his timing, improve his control, and learn the proper load and release sequence.

Swing training aid 10 comprises at least a shaft or equivalent structure and a reciprocating member disposed within the shaft. As shown in the FIGS. 1-3, the preferred swing training aid 10 comprises a golf club having at least a shaft 12, a grip 14, a head 16, and a reciprocating member 20. Generally, shaft 12 is a long tubular member comprising a circular cross section, smooth or rigid interior walls 12*a*, smooth or rigid exterior walls 12*b*, a first end 12*c*, and a second end 12*d*. The interior walls 12*a* form a channel preferably with a circular cross-section that extends along the longitudinal axis of the shaft 12. The channel formed by the interior walls 12*a* may be uniform over the entire length of the shaft, or the diameter may vary along the length of the shaft. If the diameter varies, it may taper gradually from a first diameter near the first end 12*c* to a second diameter near the second end 12*d*. Alternatively, it may step down in size at various increments along the length of the shaft. Preferably, the interior walls 12*a* are smooth and the diameter of the channel formed by the interior walls 12*a* is uniform along a substantial portion of the length of the shaft as shown in particular in FIG. 3. Shaft 12 can have any conventional degree of stiffness and can be comprised of any material typically used for golf club shafts including but not limited to steel and graphite fiber-reinforced composite material. At the first end 12*c* of shaft 12, additional components or features may be present to facilitate attaching grip 14 to shaft 12. For example, threads or grooves may be present on the exterior walls 12*b* near the first end 12*c*. Similarly, at the second end 12*d* of shaft 12, additional components or features may be present to facilitate attaching head 16 to shaft 12.

The grip 14 comprises molded rubber, plastic, cord, or composite materials. Grip 14 can be hard or soft, have a tacky outer surface, and include features that guide a golfer's hand position. Grip 14 can have any features common to golf clubs and swing training aids as is commonly known in the art. Grip 14 is sized and formed so that it encircles shaft 12 as shown in FIGS. 1-3. Grip 14 can be attached to the first end 12*c* of shaft 12 by any conventional means and is preferably attached with commercially available double-sided tape and grip solvent to create a substantially permanent adhesive bond. Alternatively, grip can be integrally formed with shaft 12, oversized or undersized, or minimal or non-existent without changing the scope of the present invention.

Figure 4:
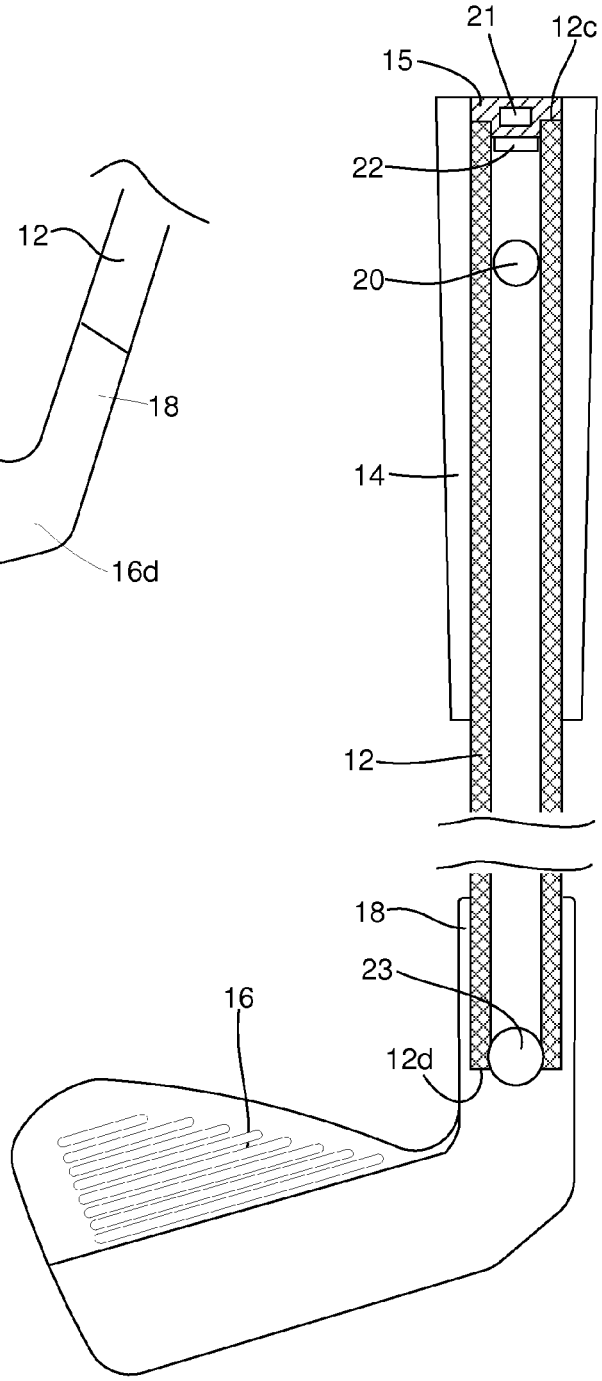
FIG. 4 is a cutaway side view of an alternative embodiment of the swing training aid of the present invention as cut according to the line A-A in FIG. 2.
Figure 8:
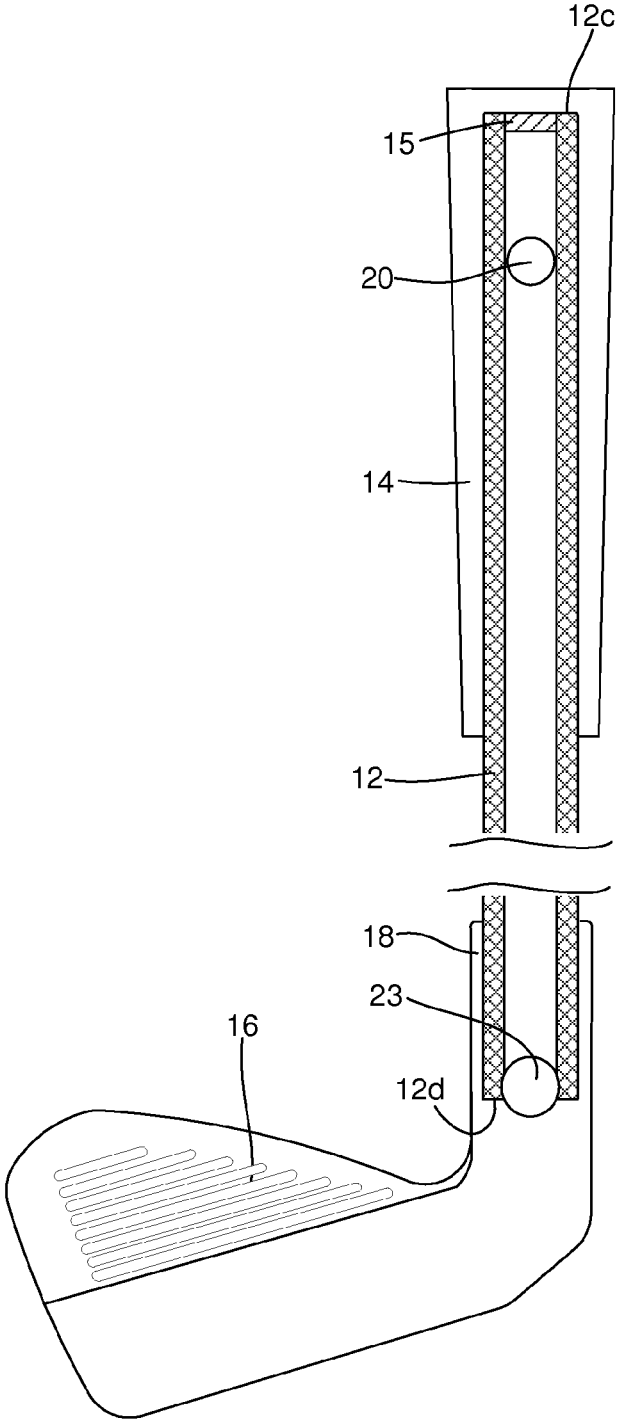
FIG. 8 is a cutaway side view of the preferred embodiment of the swing training aid of the present invention as cut according to the line A-A in FIG. 2.

Grip 14 optionally can define an opening at a first grip end 14*a* that cooperates with end cap 15 as shown in FIG. 4. Where no grip 14 is present, where it is desired to have the end cap hidden or partially concealed by the grip, or where it is desired to have the end cap independent of the grip, optional end cap 15 can be directly attached to the first end 12*c* of shaft 12. End cap 15 can be made of any rigid material and optionally comprises a rubber-type plug. End cap 15 can be positioned and secured to the end of grip 14 or to the first end 12*c* of shaft 12 by any type of connector as is known in the art. For example, grip 14 or first end 12*c* of shaft 12 can have grooves (not shown) formed at the first grip end 14*a* that cooperate with threads (not shown) formed on the outer surface of end cap 15. Alternatively, end cap 15 can be friction fit within an opening formed at the first grip end 14*a* of grip 14 or within the channel formed by at the first end 12*c* of shaft 12. End cap 15 can be securely and permanently fixed to first end 12*c* of shaft 12 or to grip 14 or it can be removable. Preferably, end cap 15 is integral with, molded to, or welded to shaft 12 at its first end 12*c* such that it meets with or protrudes at least partially into the channel formed by shaft 12 and cooperates with reciprocating member 20 as shown in FIG. 8. Also preferably, end cap 15 comprises material that makes an audible sound when reciprocating member 20 makes contact with it. For example, when reciprocating member 20 strikes end cap 15, a "ping" sound can be heard by the golfer.

Grip 14, end cap 15, or the first end 12*c* of shaft 12 can optionally include one or more additional features such as a magnet 21 for attracting reciprocating member 20 or a grip insert 22 that produces an audible sound when reciprocating member 20 contacts it. FIG. 4 illustrates an embodiment where magnet 21 is permanently encased within end cap 15 and grip insert 22 is permanently and adhesively disposed on end cap 15 such that it can make direct contact with reciprocating member 20. Alternatively, magnet 21 can be removably secured to or encased within end cap 15. Also alternatively, grip insert 22 can be partially encased within end cap 15, integral with end cap 15, or removably attached to end cap 15 so that it can be swapped with other inserts. For example, grip insert 22 can attach to end cap 15 with a hook and loop type of connector (not shown) or be secured with cooperating threads and grooves (not shown). Grip insert 22 can be any shape as long as it fits within the channel formed by shaft 12 and cooperates with reciprocating member 22. For example, grip insert can be tubular, spherical, or angular, and its surface or surfaces can be flat, concave, or convex. Where no end cap is present, the optional features can be incorporated into the first grip end 15*a* of grip 15 or directly within first end 12*c* of shaft 12 without changing the scope of the invention.

Figure 5:
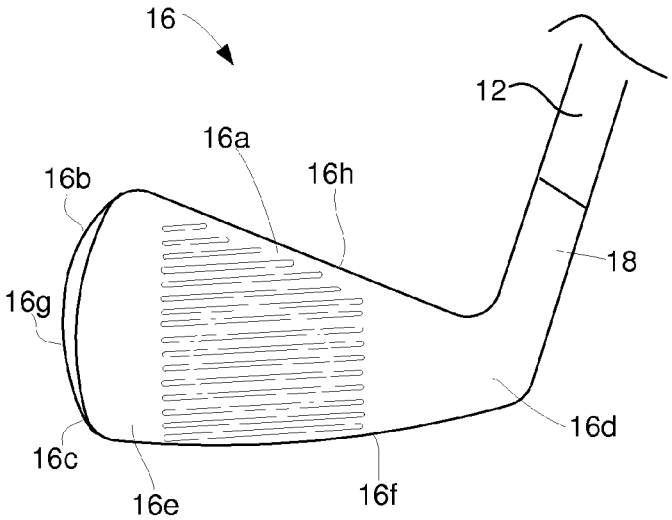
FIG. 5 is a perspective view of one embodiment of a club head of the swing training aid of the present invention.

The head 16 can be any available type of golf club heads. For example, it can be made of wood, iron, titanium, steel, other alloys or hybrid materials, be solid or hollow, have center weighting or perimeter weighting, have a cavity back or muscleback, be forged or cast, and/or be large, small or oversized. Head 16 attaches to the second end 12*d* of shaft 12, and it can attach so that it is aligned with the shaft or offset from the shaft. Head 16 comprises a face 16*a* with optional grooves (not labeled), a back 16*b*, a sole 16*c*, a heel 16*d*, a toe 16*e*, a leading edge 16*f*, a trailing edge 16*g*, a top edge 16*h*, and a hosel 18 as shown in FIG. 5. Hosel 18 is designed to cooperate with the second end 12*d* of shaft 12 as shown in FIGS. 1-3. Hosel 18 preferably defines a socket or bore sized to cooperate with the second end 12*d* of shaft 12. The depth of the socket or bore defined by hosel 18 can be any depth appropriate for the length and type of cooperating shaft as is commonly understood in the art. Head 16 is permanently or removeably secured to the second end 12*d* of shaft 12 by any conventional manner as commonly known to someone skilled in the art. For example, head 16 may be attached with adhesive and small metal pins disposed through cooperating holes in head 16, shaft 14, it may be bonded to the shaft with adhesive, or it may be secured with cooperating threads and grooves. Preferably, the second end 12*d* of shaft 12 is permanently disposed in the bore defined by hosel 18 with adhesive as is commonly understood by someone skilled in the art of making golf clubs.

Optionally, head 16 can further comprise a head insert 23 disposed within the bore defined by hosel 18. Head insert 23 can be an audible indicator such as that described above with respect to grip insert 22 or it can be a ball bearing that is slightly larger than reciprocating member and sized to frictionally fit at the second end 12*d* of shaft 12 as shown in FIG. 4. Head insert 23 can be permanently or removeably attached to head 16. Alternatively, the optional head insert 23 can be permanently or removeably disposed within the second end 12*d* of shaft 12.

Reciprocating member 20 can be any type of apparatus capable of sliding, rolling, or otherwise traveling between one end of a hollow shaft and another. Reciprocating member 20 can be any size or shape that loosely fits within the channel formed by the interior wall 12*a* of shaft 12 and that is capable of translating or reciprocating between a first position and a second position in the channel formed by shaft 12. For example, reciprocating member 20 can have a tubular shape such that it slides within shaft 12 during a golf swing. Alternatively, it can be hourglass shape or elliptical shape that slides within shaft 12 during a golf swing or a spherical shape such that it slides and rolls within shaft 12 during a golf swing. Preferably, reciprocating member 20 has a spherical shape with a diameter that is slightly smaller than the diameter of the channel formed by interior wall 12*a* of shaft 12. More preferably, reciprocating member 20 is a ball bearing. Optionally, reciprocating member 20 also can be magnetized to cooperate with one or magnets disposed in either end of the shaft 12, grip 14, end cap 15, or head 16. Where swing training aid 10 comprises a removable end cap 15, reciprocating member 20 can be one of several interchangeable reciprocating members having differing weights, sizes, and shapes so that swing training aid 10 is easily customizable.

Figure 6:
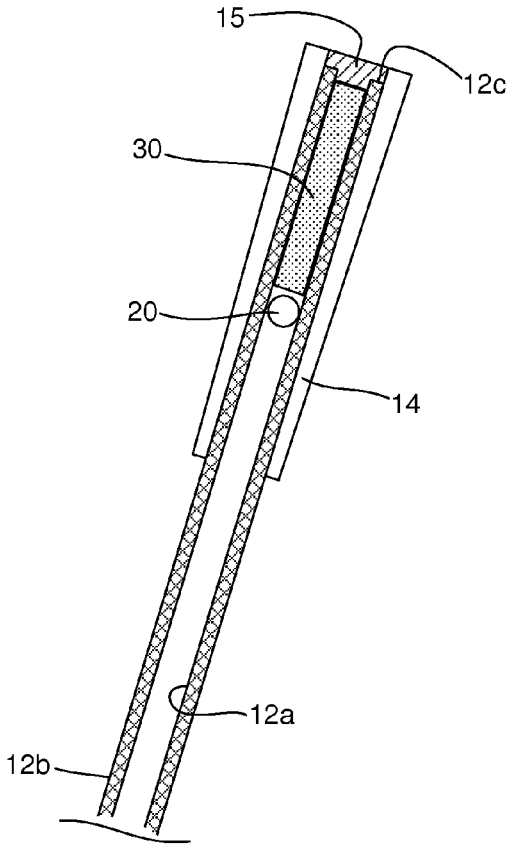
FIG. 6 is a cutaway side view of the swing training aid of the present invention as cut according to the line A-A in FIG. 2 that shows an optional feature.

An additional feature that can be incorporated into swing training aid 10 is a moveable and removable insert or stopper 30 disposed within the channel formed by shaft 12 as shown in FIG. 6. Stopper 30 can be adjusted to shorten the distance that the reciprocating member 20 travels along the channel formed by shaft 12. Stopper 30 can be any length and can be inserted or removed depending on the specific training needs of the golfer. For example, an appropriate stopper can be inserted to train the golfer to have a shorter or longer backswing. FIG. 6 illustrates an embodiment of this feature.

Figure 7:
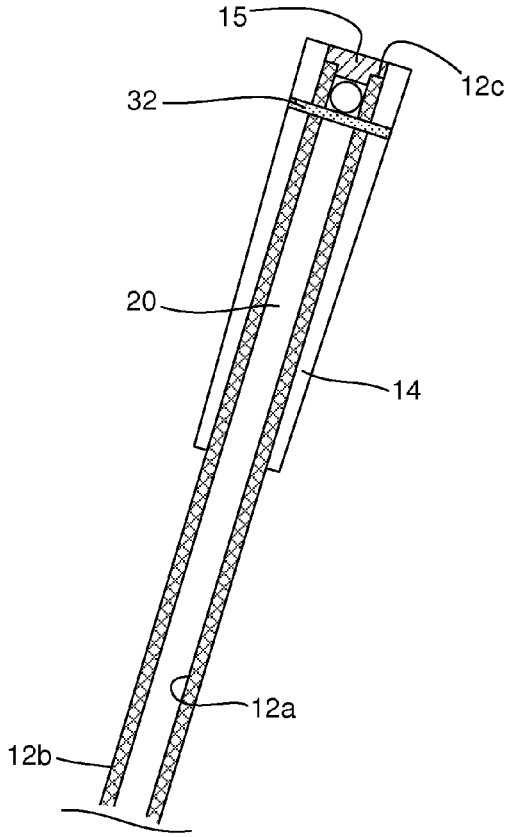
FIG. 7 is a cutaway side view of a portion of the swing training aid of the present invention as cut according to the line A-A in FIG. 2 that shows an optional feature.

Another additional feature that can be incorporated into swing training aid 10 is a physical feature or locking apparatus that, when activated, substantially prevents reciprocating member 20 from translating within the channel when a golfer wishes to use the club without the training feature. For example, one or more pins 32 can be inserted through opposing bores and across the channel of the shaft as shown in FIG. 7. Alternatively, a strong magnet can be inserted to hold the reciprocating member throughout the swing or a flap can be raised with the push of a toggle or button (not shown).

To use the swing training aid 10 of the present invention, a golfer grips the training aid 10 at grip 14, assumes an appropriate stance, and aligns the face of the club head 16 with a golf ball as he would commonly do when playing golf. Next, the golfer begins a takeaway movement where the hands and arms move together away from the body as the swing training aid 10 is swung back and away from the golf ball. During the backswing, the golfer anticipates the feedback he will receive from reciprocating member 20 travelling along the shaft 20 and striking the shaft end 12*c* or grip insert 22. If the golfer keeps training aid 10 in the proper swing plane and when the golfer reaches the ideal top of his backswing, reciprocating member strikes the shaft end 12*c* or grip insert 22. Most golfers will be able to feel the reciprocating member strike the shaft end 12*c* or grip insert 22 and preferably will also hear an audible sound. After hearing and feeling the cue given by reciprocating member at the top of the backswing, the golfer is ready to swing and accordingly begins his downswing. The golfer strikes the ball with the club head and then follows through with his swing to a finish position. As swing training aid 10 travels through the downswing, reciprocating member is released from its position at the first end 12*a* of shaft 12 to travel to the second end 12*b* of shaft 12 where it will strike head insert 23 if present. As with the backswing, most golfers will feel positive feedback when swinging properly as reciprocating member 20 smoothly transfers from the first end 12*a* to the second end 12*b* of shaft 12 at impact with the ball. Additionally, as the golfer feels and possibly hears the positive feedback from the swing training aid 10 when he swing properly, the golfer will also optimally strike the ball and see the positive outcome of his improved swing.

While use of swing training aid 10 is described in connection with striking a golf ball, swing training aid can also be used without a golf ball present. Repeated practice swings will teach the golfer when he is properly loading and releasing the club. In particular, it may provide positive feedback to the golfer when his tempo is appropriate and when he has achieved a smooth and powerful change of direction at the top of the swing. Additionally, positive feedback from the swing training aid 10 can teach the golfer to use a three-quarter backswing as used by many professional golfers and to realize the benefit of a short and powerful swing. Also additionally, through experiencing the positive feedback from the swing training aid 10, the golfer may increase his swing speed, learn to use his body more and shorten his arm position as seen among top professional golfers, improve his timing, improve his control, and learn the proper load and release sequence.

While there has been illustrated and described what is at present considered to be the preferred embodiment of the present invention, it will be understood by those skilled in the art that various changes and modifications may be made and equivalents may be substituted for elements thereof without departing from the true scope of the invention disclosed, but that the invention will include all embodiments falling within the scope of the claims.

I claim:

1. A swing training aid comprising:

a. a shaft comprising a first end and a second end wherein the shaft defines a channel extending from near the first end to near the second end;

b. a reciprocating member disposed in the channel defined by the shaft;

c. a grip attached to the first end of the shaft; and d. an end cap removably secured to the grip and positioned such that it can cooperates with the first end of the shaft.

2. The swing training aid of claim 1 further comprising a first insert secured to the end cap and positioned such that it can cooperate with the reciprocating member when the reciprocating member is near the first end of the shaft.

3. The swing training aid of claim 2 wherein the first insert is configured such that it makes an audible sound when the reciprocating member touches it.

4. A swing training aid for golf comprising:

a. a shaft comprising a first end and a second end wherein the shaft defines a channel extending from near the first end to near the second end;

b. a reciprocating member disposed in the channel defined by the shaft;

c. a grip attached to the first end of the shaft;

d. an end cap positioned such that it cooperates with the first end of the shaft and configured such that it can cooperate with the reciprocating member when the reciprocating member is near the first end of the shaft and such that it makes an audible sound when the reciprocating member touches it;

e. a head attached to the second end of the shaft wherein the head is configured so that it can strike a golf ball; and f. an insert positioned such that it cooperates with the second end of the shaft and configured such that it can cooperate with the reciprocating member when the reciprocating member is near the second end of the shaft and such that it makes an audible sound when the reciprocating member touches it.

5. The swing training aid of claim 4 further comprising a stopper removably secured in the channel defined by the shaft such that it shortens the overall length of the channel.

6. The swing training aid of claim 4 further comprising a locking apparatus positioned at least partially in the channel defined by the shaft such that when the locking apparatus is activated it prevents the reciprocating member from reciprocating.

* * * * *